US007036563B2

(12) United States Patent
Angel et al.

(10) Patent No.: US 7,036,563 B2
(45) Date of Patent: May 2, 2006

(54) TUBESHEET SUPPORT ARRANGEMENT FOR A FGTT (FLUE-GAS-THROUGH-THE-TUBES)HEAT EXCHANGER

(75) Inventors: John H. Angel, Pittsburgh, PA (US); Gregory G. Homoki, Allison Park, PA (US); Eric W. Jenkins, Pittsburgh, PA (US); Clifford B. Mikesell, Wexford, PA (US); James G. Oyler, Pittsburgh, PA (US); C. David Roland, Mars, PA (US); Bryon E. Williams, Gibsonia, PA (US)

(73) Assignee: ALSTOM Technology Ltd, Baden (CH)

( * ) Notice: Subject to any disclaimer, the term of this patent is extended or adjusted under 35 U.S.C. 154(b) by 174 days.

(21) Appl. No.: 10/616,527

(22) Filed: Jul. 10, 2003

(65) Prior Publication Data

US 2005/0006056 A1 Jan. 13, 2005

(51) Int. Cl.
*F28F 9/02* (2006.01)

(52) U.S. Cl. ..... 165/81; 165/82; 165/134.1; 165/158

(58) Field of Classification Search ..... 165/81–83, 165/134.1, 158
See application file for complete search history.

(56) References Cited

U.S. PATENT DOCUMENTS

| | | | | | |
|---|---|---|---|---|---|
| 1,953,293 | A | * | 4/1934 | Forncrook | 165/81 |
| 1,953,678 | A | * | 4/1934 | Govers | 165/83 |
| 1,980,791 | A | * | 11/1934 | Duggan et al. | 165/82 |
| 2,004,469 | A | * | 6/1935 | Leach | 165/81 |
| 2,075,511 | A | * | 3/1937 | De Baufre | 165/82 |
| 2,458,756 | A | * | 1/1949 | Watson | 165/82 |
| 3,907,026 | A | * | 9/1975 | Mangus | 165/134.1 |

* cited by examiner

*Primary Examiner*—Leonard R. Leo
(74) *Attorney, Agent, or Firm*—Arthur E. Fournier, Jr.; Timothy J. Olson

(57) ABSTRACT

A tubesheet support arrangement 11 supports a tubesheet 10 within a vessel 12, the tubesheet 10 maintaining a plurality of tubes 22 at fixed radial spacings from one another with the tubes 22 extending from the tubesheet 10 on a tube projecting side of the radial plane RP. The tubesheet support arrangement 11 comprises a fully circumferentially extending intermediary support element 24. The intermediary support element 24 is subjected to compression due its support of the weight of the tubesheet 10 and the tubes 22 on the lower portion of the vessel 12.

8 Claims, 3 Drawing Sheets

TUBESHEET SUPPORT ARRANGEMENT FOR A FGTT (FLUE-GAS-THROUGH-THE-TUBES)HEAT EXCHANGER

BACKGROUND OF THE INVENTION

The present invention relates to a tubesheet support arrangement for supporting a tubesheet in a vessel and, more particularly, to a tubesheet support arrangement for supporting a tubesheet in a vessel in the form of a FGTT (flue-gas-through-the-tubes) heat exchanger operable to preheat combustion air.

Various vessels, of which a FGTT (flue-gas-through-the-tubes) heat exchanger is one type, are deployed in heat exchange or industrial process operations wherein such vessels have in common an outer shell and a bundle of tubes within the interior volume of the outer shell. The bundle of tubes are commonly seated on or connected to a tubesheet which itself is supported by the outer shell. Typically, a fluid within one temperature range is passed through the tubes while a fluid in a different temperature is present in the balance of the interior volume of the outer shell. The vessel is typically supported in a vertically orientation on a base pad and may also optionally be supported in its vertical orientation by an external support framework. Thus, the tubes, which typically extend parallel to the vessel axis, are themselves vertically oriented. Also, the tubes are typically exposed to elevated temperatures (in some circumstances, temperatures greater than 300 degrees F.) and, as well, the tubesheet is exposed to elevated temperatures which are relatively higher than the temperatures to which the outer shell is exposed. This phenomenon results in potentially detrimental differential thermal expansions of the tubes and the tubesheets relative to the outer shell.

U.S. Pat. No. 5,759,500 to Garner et al discloses a shell and tube heat exchanger having a floating tubesheet at one end which is suitable for deployment in chemical plants, petroleum refineries, steam plants, and similar installations. The exchanger disclosed in U.S. Pat. No. 5,759,500 to Garner et al includes a shell having inlet and outlet ports, an elongated bundle of tubes positioned within the shell, and transverse baffles for directing the fluid back and forth across the tubes. The tubes are supported by tubesheets, one of which is normally stationary by attaching it to the internal surface of the shell, and the other of which is "floating" to accommodate changes in tube length due to thermal expansion. The floating tubesheet is free to move axially relative to the shell which may expand and contract axially a different amount relative to the tubes. The baffles are supported on the stationary tubesheet by tierods and spacers and are thereby positioned along the length of the tubes.

U.S. Pat. No. 4,976,928 to Foster et al discloses a device for performing exothermic catalytic gas reactions for the synthesis of ammonia under high pressures, the device comprising catalyst containers and tubular heat exchangers in an inner shell enclosed by an outer shell. Heat exchanger tube bundles pass through the center of two separate catalyst containers. A packing seal seals around an upper tubesheet. U.S. Pat. No. 3,442,626 to Browne discloses a tube bundle which passes throughout two separate catalyst chambers so the tubes are in direct contact with the catalyst which exposes the tubes to thermal and chemical extremes. The devices disclosed in U.S. Pat. No. 4,976,928 to Foster et al and U.S. Pat. No. 3,442,626 to Browne must deal with the problems, which are particularly apt to occur at very high temperatures, of differential thermal expansion radially and axially between the tubesheets, tube bundles and shell.

Thus, it can be seen that various tubesheet support arrangements have been proposed which provide thermal transition and tubesheet support functions while allowing for differential expansion between the relatively hotter tubesheet and the cooler outer shell of the vessel. These tubesheet support arrangements are subjected to thermal stresses resulting from normal cycling and abnormal temperature excursions which may eventually result in thermal fatigue cracking and failure of the tubesheet support arrangement. A typical failure mechanism of a tubesheet support arrangement is the propagation of a crack circumferentially around the tubesheet support arrangement, usually at the hot end of the tubesheet support arrangement. This crack compromises the ability of the tubesheet support arrangement to support the tubesheet in the desired operational position, whereupon the weight of the tubes may cause the bundle of tubes to drop, leading to internal damage of the vessel, including internal damage which permits leakage of the previously segregated tube fluid and the other fluid in the vessel. Excessive leakage in the case of a heat exchange vessel such as a FGTT (flue-gas-through-the-tubes) heat exchanger may render the heat exchanger unusable. The ability of the tubesheet support arrangement to support the tubesheet in the desired operational position may be compromised to such a degree that the tubesheet support arrangement can no longer support the tube bundle, in which event the tube bundle (and the tubesheet support arrangement) falls and further damages the vessel.

Although approaches have been suggested, as noted hereinabove, to provide a tubesheet support arrangement which minimizes the above-noted problems, there still exists the need for a tubesheet support arrangement which optimally accommodates differential thermal expansion between the tubesheet and the vessel in which the tubesheet is disposed while, at the same time, ensuring that a gas tight seal exists at the tubesheet support location so as to preclude the leakage of fluid therepast.

Accordingly, it is an object of the present invention to provide a tubesheet support arrangement that addresses the risk of failure of the tubesheet support arrangement to support the tube bundle and the other concerns set forth above. Moreover, it is an additional object of the present invention to provide a tubesheet support arrangement that optimally accommodates differential thermal expansion between the tubesheet and the vessel in which the tubesheet is disposed while, at the same time, ensuring that a gas tight seal exists at the tubesheet support location so as to preclude the leakage of fluid therepast.

SUMMARY OF THE INVENTION

According to the present invention, a tubesheet support arrangement is provided which optimally accommodates differential thermal expansion between the tubesheet and the vessel in which the tubesheet is disposed.

According to one aspect of the present invention, the tubesheet support arrangement of the present invention is operable to support a tubesheet within a vessel wherein the vessel has a vessel axis, a first vessel interface structure, and a second vessel interface structure axially spaced from one another such that an axially extending placement gap is formed therebetween and the tubesheet has a plurality of apertures arrayed relative to a radial plane through the tubesheet each for receiving therein one of a plurality of tubes such that the tubesheet maintains the tubes at fixed radial spacings from one another with the tubes extending from the tubesheet on a tube projecting side of the radial plane. The tubesheet support arrangement is operable to support the tubesheet within the vessel such that the radial plane through the tubesheet is axially co-incident with the axially extending placement gap and the first vessel interface structure is disposed on the tube projecting side of the radial plane of the tubesheet.

According to further details of the one aspect of the present invention, the tubesheet support arrangement includes a fully circumferentially extending intermediary support element having one axial end sealingly connected to the tubesheet and an opposed axial end sealingly connected to the first vessel interface structure which is disposed on the tube projecting side of the radial plane of the tubesheet with the intermediary support element supporting at least the principal portion of the weight of the tubesheet and the tubes on the first vessel interface structure.

In accordance with further aspects of the present invention, the tubesheet support arrangement preferably includes a fully circumferentially extending topside boundary element that forms the sealing connection between the tubesheet and the second vessel interface structure, the topside boundary element having one axial end sealingly connected to the tubesheet. Also, the tubesheet support arrangement preferably comprises an outer vessel wall component extending fully circumferentially and having one axial end sealingly connected to the first vessel interface structure and an opposed axial end sealingly connected to the second vessel interface structure.

According to a further additional aspect of the present invention, the vessel is a FGTT (flue-gas-through-the-tubes) heat exchanger vessel and the tubesheet support arrangement is operable to support a tubesheet from which a plurality of heat exchanger tubes are supported.

BRIEF DESCRIPTION OF THE DRAWINGS

The features and advantages of the present invention will be best appreciated upon reference to the following detailed description and the accompanying drawings, in which.

DETAILED DESCRIPTION OF THE INVENTION

Figure 1:
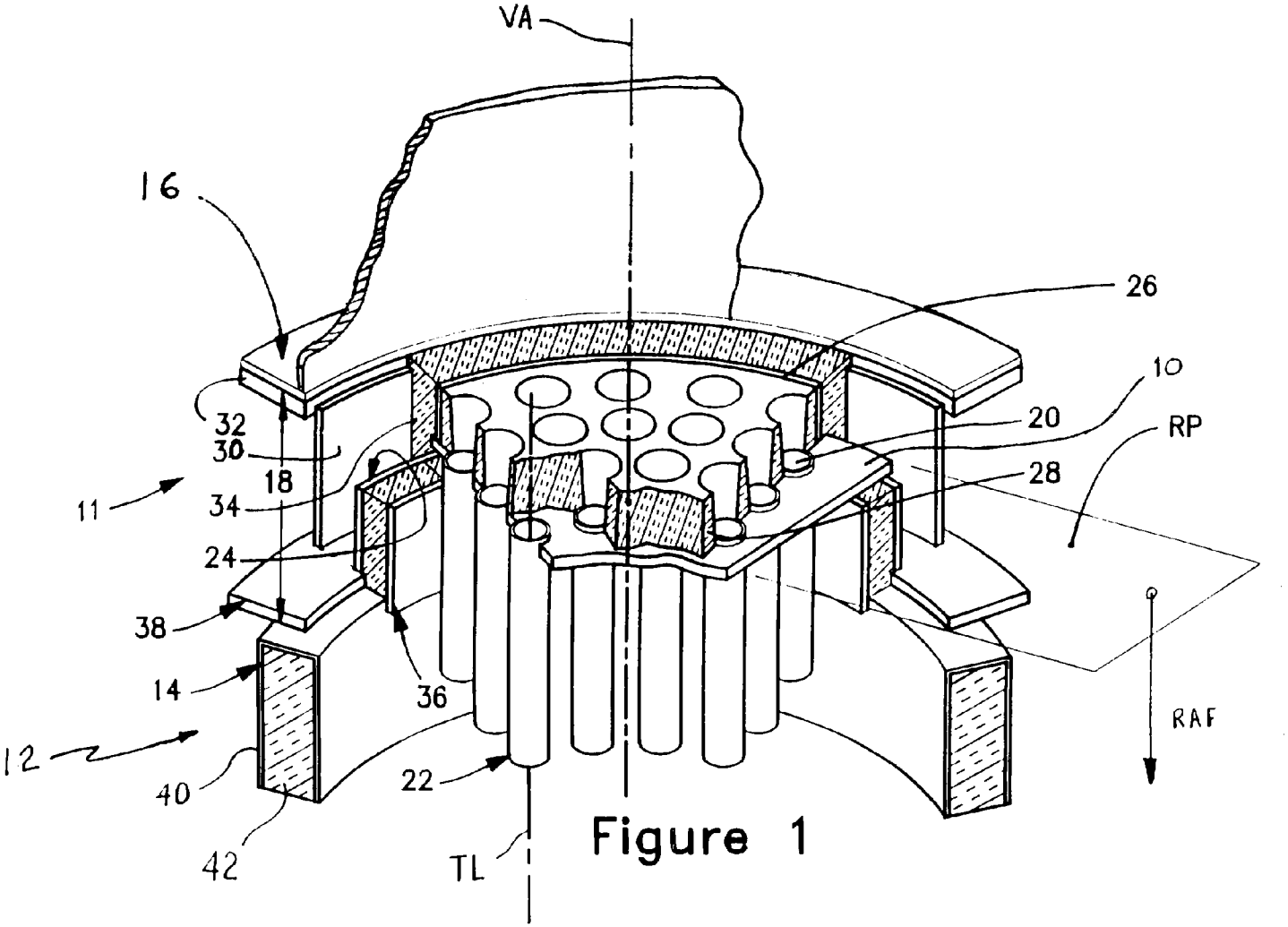
FIG. 1 is a sectional perspective view of one embodiment of the tubesheet support arrangement of the present invention in its operational position in a typical or representative tubesheet environment.
Figure 2:
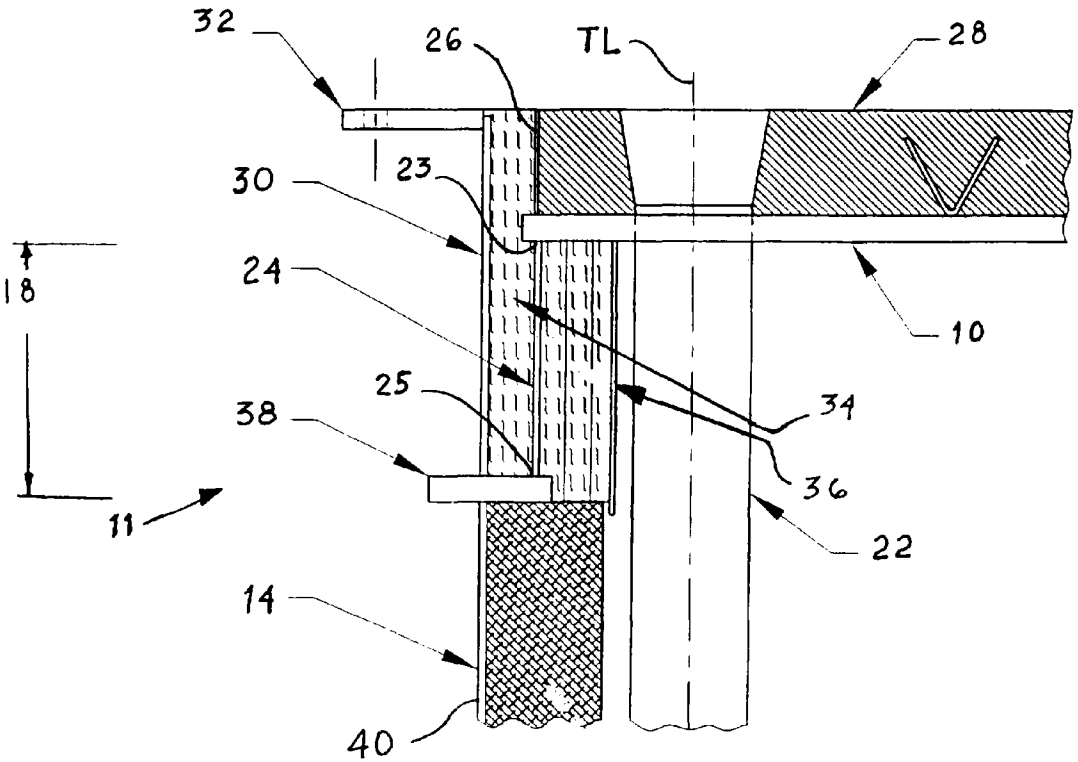
FIG. 2 is an enlarged elevational view of the one embodiment of the tubesheet support arrangement shown in FIG. 1.
Figure 3:
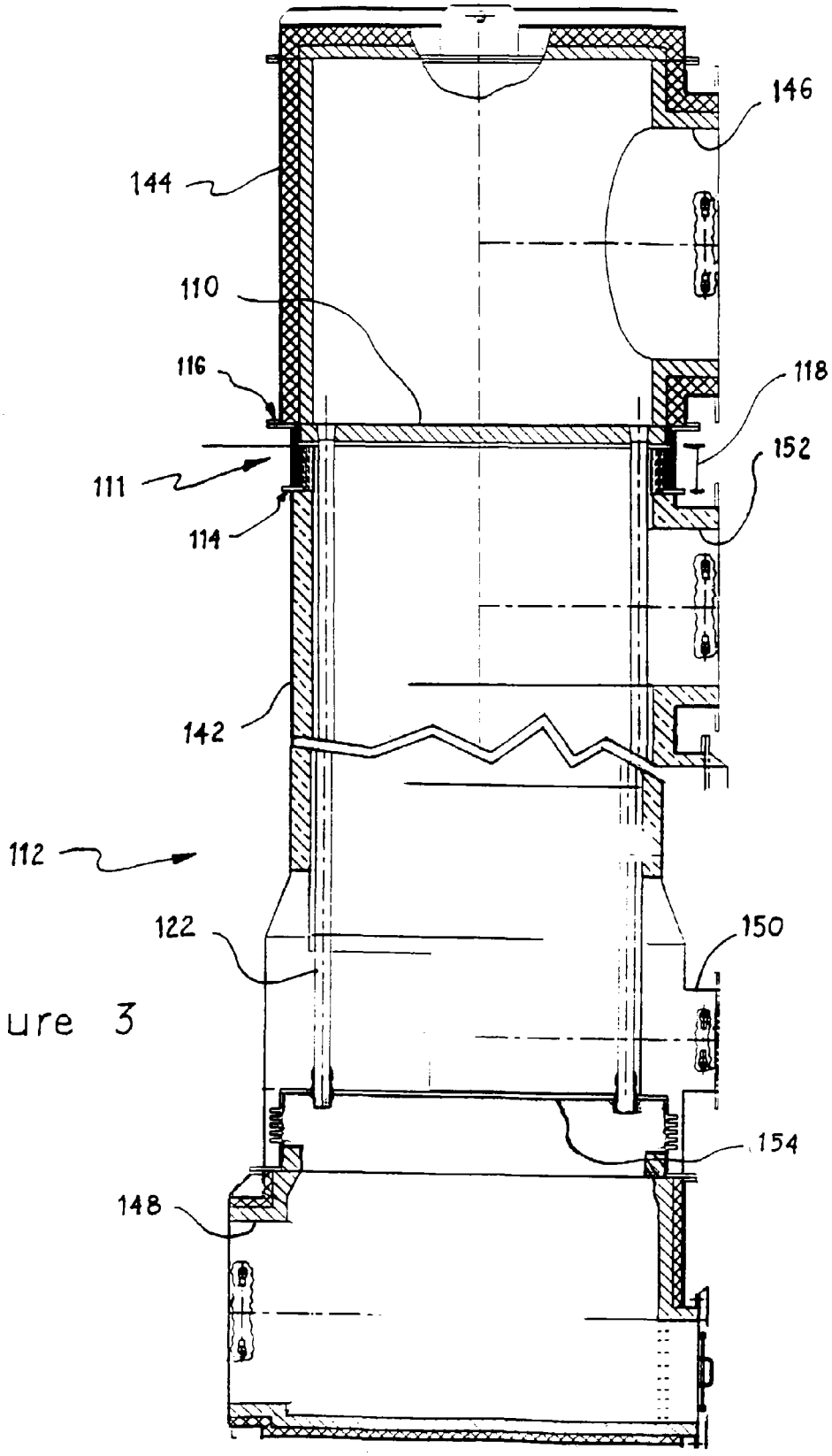
FIG. 3 is a front elevational sectional view of a FGTT (flue-gas-through-the-tubes) heat exchanger vessel having the one embodiment of the tubesheet support arrangement of the present invention mounted thereon.

A detailed description of the tubesheet support arrangement of the present invention is now provided with reference to FIG. 1, which is a sectional perspective view of one embodiment of the tubesheet support arrangement of the present invention in its operational position in a typical or representative tubesheet environment, FIG. 2, which is an enlarged elevational view of the one embodiment of the tubesheet support arrangement shown in FIG. 1, and FIG. 3, which is a front elevational sectional view of a FGTT (flue-gas-through-the-tubes) heat exchanger vessel having the one embodiment of the tubesheet support arrangement of the present invention mounted thereon. As seen in FIG. 1, there is illustrated therein a tubesheet support arrangement 11 for the support of a tubesheet 10 within a vessel 12.

The vessel 12 may be any one of a range of types of vessels, which may be of conventional design or not, and which are configured to be deployed, or are suitable for deployment, in heat exchange or industrial process operations in which an enclosed volume is required. A vessel of this type, which the following description of the vessel 12 is intended to be a representative description thereof, is exemplified by the principal features of an outer shell and a bundle of tubes within the interior volume of the outer shell with the bundle of tubes being supported by at least one tubesheet. A further principal feature of such a vessel exemplified by the vessel 12 is that the tubesheet is supported relative to the outer shell such that the tubes extend within the outer shell in a manner which permits, at the least, elongation of the tubes along their axial extent due to thermal expansion. In connection with a typical deployment of a vessel in a heat exchange process, a fluid within one temperature range is passed through the tubes while a fluid in a different temperature range is present in the balance of the interior volume of the outer shell and the heat exchange between the two different fluids gives rise to thermal expansion resulting in elongation of the tubes.

The vessel 12 has a vessel axis VA and a lower portion and an upper portion which together define an enclosed volume centered on the vessel axis VA. The lower portion of the vessel 12 forms a first vessel interface structure 14 and the upper portion of the vessel 12 forms a second vessel interface structure 16 with the first vessel interface structure 14 and the tubesheet 10 being axially spaced from one another such that an axially extending placement gap 18 is formed therebetween. The axially extending placement gap 18 is occupied by the tubesheet support arrangement 11, in a manner which will be described shortly hereinafter.

The tubesheet 10 has a plurality of apertures 20 arrayed relative to a radial plane RP, each aperture extending through the tubesheet 10 and receiving therein one of a plurality of tubes 22 such that the tubesheet 10 maintains the tubes 22 at fixed radial spacings from one another with the tubes 22 extending from the tubesheet 10 on a tube projecting side of the radial plane RP.

The tubesheet 10 is disposed within the vessel 12 such that the radial plane RP through the tubesheet 10 is axially co-incident with the axially extending placement gap 18 (relative to the vessel axis VA) and the first vessel interface structure 14 is disposed on the tube projecting side of the radial plane RP of the tubesheet 10. Due to this oriented disposition of the tubesheet 10, the tubes 22, each of which has a longitudinal axis TL, are fixedly supported within the vessel 12 with their longitudinal axes TL parallel to the vessel axis VA.

To illustrate one typical heat exchange operation which is representative of the operational interplay of the vessel 12, on the one hand, and the tubesheet 10 and the tubes 12, on the other hand, reference is now had to FIG. 3, which is a front elevational sectional view of a FGTT (flue-gas-through-the-tubes) heat exchanger vessel 112 having mounted thereon the one embodiment of the tubesheet support arrangement of the present invention, hereinafter designated as the tubesheet support arrangement 111, which supports on the heat exchanger vessel 112, in the interior thereof, an upper tubesheet 110 having a plurality of tubes 122 mounted thereto.

The heat exchanger vessel 112 is specifically configured to perform a heat exchange operation in which heat from a relatively higher temperature combustion or flue gas exiting a combustion chamber (not shown) is transferred to a relatively lower temperature incoming air which, following the heat exchange operation, flows to the combustion chamber to support the combustion operation thereat. The heat exchanger vessel 112 provides an enclosed volume in which this heat exchange operation occurs and this enclosed volume is formed by a lower portion 142 of the heat exchanger vessel 112 having a top defined by a first vessel interface structure 114 and an upper portion of the heat exchanger vessel 112 in the form of a plenum 144 having a bottom defined by a second vessel interface structure 116. The first vessel interface structure 114 and the second vessel interface structure 116 are axially spaced from one another such that an axially extending placement gap 118 is formed therebetween which is occupied by the tubesheet support arrangement 111.

The heat exchanger vessel 112 has several inlets and outlets including a gas inlet 146 formed in an plenum 144 of the heat exchanger vessel 112 and communicated with the combustion chamber for the flow therethrough of combustion gas at, for example, a temperature of typically 1500 degrees F. or higher, and a gas outlet 148 formed in the lower portion 142 of the heat exchanger vessel 112 communicated with a downstream combustion gas handling structure (not shown) for the flow thereto of the combustion gas after heat therefrom has been transferred to the incoming air during the heat exchange operation in the heat exchanger vessel 112. An incoming air inlet 150 is formed in the lower portion 142 of the heat exchanger vessel 112 and communicated with an incoming air intake structure (not shown) for the flow therethrough of incoming air at a temperature, for example, of 100 degrees F. An air outlet 152 is also formed in the lower portion 142 of the heat exchanger vessel 112, above the incoming air inlet 150, and communicated with the combustion chamber for the flow therethrough of the incoming air which has been heated, by virtue of the heat exchange process in the heat exchanger vessel 112, to a higher temperature than its initial temperature—a higher temperature, for example, of 1200 degrees F.—upon entering the heat exchanger vessel 112 through the incoming air inlet 150.

The tubes 122 extend vertically from their supported positions on the upper tubesheet 110 and the respective lower ends of the tubes 122 are received by a lower tubesheet 154 by an arrangement, for example, wherein each tube 122 is sealingly connected to the lower tubesheet 154 by an associated individual mechanical sealing structure such as, for example, a bellows seal, and the lower tubesheet 154 is itself sealingly connected to the lower portion 142 of the heat exchanger vessel 112 by a mechanical sealing structure such as, for example, a bellows seal. In any event, the mounting and sealing connection of the tubes 122 to the lower tubesheet 154, on the one hand, and the mounting and sealing connection of the lower tubesheet 154 to the lower portion 142 of the heat exchanger vessel 112, on the other hand, is such that the elongation of the tubes 122 due to thermal expansion leads to downward displacement of the lower tubesheet 154 with appropriate deformation via, for example, contraction, of the bellows seals.

The individual mechanical sealing structures which sealingly connect the lower ends of the tubes 122 to the lower tubesheet 154 only provide relatively low resistance to deformation. Thus, it can be seen that, via this configuration for supporting the tubes 122, the principal portion of the weight of the tubes 122 is supported by the upper tubesheet 110 with the lower tubesheet 154 providing relatively much less support of the tubes 122 by virtue of its receipt of the lower ends of the tubes 122.

The combustion gas flows into the heat exchanger vessel 112 via the gas inlet 146, flows through the plenum 144 of the heat exchanger vessel 112 and thereafter flows into and through the tubes 122 before exiting the heat exchanger vessel 112 via the gas outlet 148. The incoming air flows into the heat exchanger vessel 112 via the incoming air inlet 150, flows through that portion of the interior volume of the heat exchanger vessel 112 which is axially bounded by the upper tubesheet 110 and the lower tubesheet 154, whereupon the incoming air in that portion of the interior volume of the heat exchanger vessel 112 is in contact with the exterior surfaces of the tubes 122, and thereafter exits via the air outlet 152.

It can be understood that non-contact heat exchange occurs between the relatively hotter combustion gas flowing through the tubes 122 and the relatively cooler incoming air flowing past and in contact with the exterior of the tubes 122. Moreover, it can be understood that the heat exchange process results in an increase in the temperature of the tubes 122 as heat from the combustion gas flowing through the tubes is transferred through the tubes to the relatively cooler incoming air and that the upper tubesheet 110 is subjected to thermal expansion by virtue of the mounting of the top portions of the tubes 122 to the upper tubesheet 110. The upper tubesheet 110 expands radially and axially due to this phenomenon and the tubesheet support arrangement 11 is specifically configured to optimally accommodate differential thermal expansion between the upper tubesheet 110 and the vessel 112 in which the tubesheet 110 is disposed while, at the same time, ensuring that a gas tight seal exists at the tubesheet support location so as to preclude the leakage of fluid therepast.

Reference is again had to FIGS. 1 and 2 for a description in detail of the novel tubesheet support arrangement of the present invention which provides this optimum, leakage minimizing tube support function. The tubesheet support arrangement 11 comprises a fully circumferentially extending intermediary support element 24 which extends axially between the tubesheet 10 and the first vessel interface structure 14 which is disposed on the tube projecting side of the radial plane RP of the tubesheet 10. The intermediary support element 24 supports the tubesheet 10 on the first vessel interface structure 14. The intermediary support element 24 may have an intermittent or non-continuous periphery in the circumferential direction but preferably has a fully circumferentially extending configuration and is most preferably configured as a cylinder having one axial end sealingly connected at an upper sealing connection 23 to the tubesheet 10 and an opposed axial end sealingly connected to the first vessel interface structure 14 at a lower sealing connection 25. If the intermediary support element 24 is configured with a continuous periphery, such as the preferred cylindrical configuration, the intermediary support element 24 provides, in addition to its tubesheet support function, a gas-tight sealing function which cooperates with other structure in the vessel 12 to prevent the leakage of fluid therepast. In contrast, if the intermediary support element 24 is configured with an intermittent or non-continuous periphery in the circumferential direction, the intermediary support element 24 will not itself provide a gas-tight seal function and the tubesheet support arrangement 11 may then additionally comprise a separate gas-tight sealing element (not shown). The tubesheet support arrangement 11 also comprises a topside boundary element 26 extending from the tubesheet 10.

The intermediary support element 24 is subjected to compression due the application thereagainst of a respective axial force RAF toward the tube projecting side of the radial plane RP of the tubesheet 10. The respective axial force RAF is exerted due to the weight of the tubesheet 10 and the tubes 122 and, more particularly, due to the balance of the weight of the tubesheet 10 and the tubes 122 which is not otherwise supported by another structure connected to the vessel 12 such as, for example, a structure such as the lower tubesheet 154 described with respect to FIG. 3. In other words, the principal portion of the weight of the tubesheet 10 and the tubes 22 exerts the respective axial force RAF on the intermediary support element 24. The topside boundary element 26 extending between the tubesheet 10 and the second vessel interface structure 16 is in the form of a fully circumferentially extending axially open-ended cylinder having one axial end sealingly connected to the tubesheet 10. Also, an insulation element 28 is provided on the tubesheet 10 having a cylindrical outer periphery whose diameter is compatibly configured with the inner diameter of the topside boundary element 26 such that the insulation element 28 and the topside boundary element 26 are in closely adjacent proximity to one another.

The tubesheet support arrangement 11 also preferably includes an outer vessel wall component 30 extending fully circumferentially around the intermediary support element 24 at a radially outward spacing therefrom and having one axial end sealingly connected to the first vessel interface structure 14 and an opposed axial end sealingly connected to the second vessel interface structure 16. An annular flange 32 is connected to and extends radially from the upper portion of the outer cylindrical periphery of the outer vessel wall component 30 and the top surface of the annular flange 32 is in flush mounted contact with a annular flange at the lower end of the second vessel interface structure 16. The inner radius of the outer vessel wall component 30 is larger than the outer radius of the intermediary support element 24 and the outer radius of the topside boundary element 26 such that a circumferentially extending annulus is formed between the outer vessel wall component 30, on the one hand, and the intermediary support element 24 and the topside boundary element 26, on the other hand, in which an insulative material 34 is disposed.

An inside periphery insulation retainer 36 is disposed radially inwardly of the intermediary support element 24 and a ring of insulation is retained between the inside periphery insulation retainer 36 and the intermediary support element 24. The first vessel interface structure 14 includes a support ring 38 having an inner diametrical surface at a lesser radial spacing from the vessel axis VA than the inner diameter surface of the intermediary support element 24 and an outer diametrical surface at a greater radial spacing from the vessel axis VA than the outer diametrical surface of the intermediary support element 24. The opposed axial end of the intermediary support element 24 is sealingly connected to the top surface of the support ring 38 by the lower sealing connection 25. It can be seen that the axially extending placement gap 18, in this embodiment, extends from the bottom edge of the topside boundary element 26 which is in contact with the top surface of the tubesheet 10 to the interface or parting line at which the lower surface of the support ring 38 and the top surface of the first vessel interface structure 14 are in contact with one another. The first vessel interface structure 14 may be in the form of a conventional vessel outer wall configuration comprising an axially rigid cylindrical shell 40 forming an outer wall and a ring of insulative material disposed in flush mounting contact with the inner diametrical surface of the cylindrical shell 40. The cylindrical shell 40 supports thereon the support ring 38.

In the typical orientation of the vessel 12, the vessel 12 is either vertically oriented, with its vessel axis VA being vertical, or is at an angle less than ninety (90) degrees relative to vertical. Thus, as the tubes 22, which, as noted, are supported within the vessel 12 with their longitudinal axes TL parallel to the vessel axis VA, undergo elongation as a result of thermal expansion in the direction of their longitudinal axes TL. In order to optimize the capability of the tubesheet support arrangement (1) to avoid or delay catastrophic failure resulting in loss of support of the tubes 22 within the vessel 12 and (2) to minimize leakage, the tubesheet support arrangement is specifically configured to ensure that it will be subjected to a compressive force by virtue of its role in supporting the principal portion of the weight of the tubes 22.

The tubesheet support arrangement optimally compensates for the problems arising from the differential thermal expansion. For example, the placement of the tubesheet support arrangement in compression (as opposed to tension) ensures that any creep which does occur will not cause creep rupture. Also, when thermal fatigue does eventually occur, the tubes 22 will continue to be supported by the tubesheet 10 and leakage will be minimized for the reason that the weight of the tubes 22 will tend to push together the edges of any crack, such as a circumferential crack, which may occur in the intermediary support element 24. Additionally, in the event of an axial collapse of the intermediary support element 24, the tubesheet 10 will simply shift downwardly due to its disposition on the top of the intermediary support element 24 with the weight of the tubes 22 acting to close any crack edges rather than pulling the edges apart. This downward shift of the tubesheet 10 will reduce leakage to an acceptably low level and avoid further damage to other components in the vessel, whereupon the respective heat exchange operation and/or the industrial process can continue.

It is further to be noted that the tubesheet support arrangement 11 is subjected to compressive stresses which reduce the maximum tensile bending stresses, whereby the fatigue life is increased. Also, the annular rings 34 and 36 of refractory material are preferably formed of flexible insulation such that the disposition of these rings 34 and 36 against both the inner and outer diametrical surfaces of the intermediary support element 24 acts to further reduce stresses.

The intermediary support element 24, in its preferred configuration as a cylinder, is formed of a material and formed with a height-to-thickness ratio (i.e., the ratio of its axial extent to its radial extent) so as to ensure that the intermediary support element 24 has a good axial rigidity which resists buckling. Moreover, the intermediary support element 24 and the surrounding insulation structure (comprising the respective inner and outer rings of insulative material adjacent the intermediary support element 24) are designed such that there is a linear or near-linear temperature gradient axially along the intermediary support element 24 with the temperatures along the intermediary support element 24 decreasing from the sealing contact 23 at which the intermediary support element 24 is in contact with the tubesheet 10 toward the sealing contact 25 at which the intermediary support element 24 is in contact with the support ring 38. This configuration advantageously minimizes the formation of stresses in the intermediary support element 24 which would otherwise arise due to its transition role between the relatively hotter tubesheet 10 and the relatively cooler first vessel interface structure 14 (which comprises the support ring 38). Thus, the determination of the axial extent of the intermediary support element 24 will necessarily take into account the magnitude of the temperature differential between the relatively hotter tubesheet 10 and the relatively cooler first vessel interface structure 14.

The axial extent of the intermediary support element 24 accordingly is selected such that the intermediary support element 24 has a decreasing temperature gradient from the sealing contact 23 at which the intermediary support element 24 is in contact with the tubesheet 10 toward the sealing contact 25 at which the intermediary support element 24 is in contact with the first vessel interface structure 14 with the temperature of the intermediary support element 24 at the sealing contact 25 at which the intermediary support element 24 is in contact with the first vessel interface structure 14 being nearly the same as the average temperature of the first vessel interface structure 14. This advantageously minimizes the differential thermal expansion and, accordingly, minimizes thermal stresses.

Since the invention is susceptible to various modifications and alternative forms, it should be understood that the invention is not intended to be limited to the particular forms disclosed. Rather, the scope of the invention extends to all modifications, equivalents and alternatives falling within the spirit and scope of the invention as defined by the appended claims.

What is claimed is:

1. A tubesheet support arrangement for the support of a tubesheet within a vessel, the vessel having a vessel axis and having a first vessel interface structure and a second vessel interface structure axially spaced from one another such that an axially extending placement gap is formed therebetween and the tubesheet having a plurality of apertures arrayed relative to a radial plane through the tubesheet each for receiving therein one of a plurality of tubes such that the tubesheet maintains the tubes at fixed radial spacings from one another with the tubes extending from the tubesheet on a tube projecting side of the radial plane and the tubesheet being disposed within the vessel such that the radial plane through the tubesheet is axially co-incident with the axially extending placement gap and the first vessel interface structure is disposed on the tube projecting side of the radial plane of the tubesheet, the tubesheet support arrangement comprising:

an intermediate support element having one axial end sealingly connected to the tubesheet and an opposed axial end sealingly connected to the first vessel interface structure which is disposed on the tube projecting side of the radial plane of the tubesheet, the intermediary support element supporting at least the principal portion of the weight of the tubesheet and the tubes on the first vessel interface structure;

a sealing connection between the tubesheet and the second vessel interface structure in the form of a fully circumferentially extending topside boundary element having one axial end sealingly connected to the tubesheet and an opposed axial end sealingly connected to the second vessel interface structure;

an outer vessel wall component extending fully circumferentially and having one axial end sealingly connected to the first vessel interface structure; and wherein the inner radius of the outer vessel wall component is larger than the outer radius of the intermediary support element and the outer radius of the topside boundary element such that a circumferentially extending annulus is formed between the outer vessel wall component, on the one hand, and the intermediary support element and the topside boundary element, on the other hand, and wherein insulation material is disposed in the circumferentially extending annulus.

2. A tubesheet support arrangement according to claim 1 and further comprising a ring of insulation material disposed radially inwardly of the intermediary support element.

3. A tubesheet support arrangement according to claim 2, wherein the intermediary support element includes an inner diameter surface and the first vessel interface structure includes a support ring having an inner diameter surface at a lesser radial spacing from the vessel axis than the inner diameter surface of the intermediary support element and the opposed axial end of the intermediary support element is sealingly connected to the support ring.

4. A tubesheet support arrangement for the support of a tubesheet within a vessel, the vessel having a vessel axis and having a first vessel interface structure and a second vessel interface structure axially spaced from one another such that an axially extending placement gap is formed therebetween and the tubesheet having a plurality of apertures arrayed relative to a radial plane through the tubesheet each for receiving therein one of a plurality of tubes such that the tubesheet maintains the tubes at fixed radial spacings from one another with the tubes extending from the tubesheet on a tube projecting side of the radial plane and the tubesheet being disposed within the vessel such that the radial plane through the tubesheet is axially co-incident with the axially extending placement gap and the first vessel interface structure is disposed on the tube projecting side of the radial plane of the tubesheet, the tubesheet support arrangement comprising:

an intermediary support element having one axial end sealingly connected to the tubesheet and an opposed axial end sealingly connected to the first vessel interface structure which is disposed on the tube projecting side of the radial plane of the tubesheet, the intermediary support element supporting at least the principal portion of the weight of the tubesheet and the tubes on the first vessel interface structure;

an outer vessel wall component extending fully circumferentially and having one axial end sealingly connected to the first vessel interface structure; and wherein the inner radius of the outer vessel wall component is larger than the outer radius of the intermediary support element and the outer radius of the topside boundary element such that a circumferentially extending annulus is formed between the outer vessel wall component, and the intermediary support element and the topside boundary element, on the other hand, and wherein insulation material is disposed in the circumferentially extending annulus.

5. A tubesheet support arrangement for the support of a tubesheet within a vessel, the vessel having a vessel axis and having a first vessel interface structure and a second vessel interface structure axially spaced from one another such that an axially extending placement gap is formed therebetween and the tubesheet having a plurality of apertures arrayed relative to a radial plane through the tubesheet each for receiving therein one of a plurality of tubes such that the tubesheet maintains the tubes at fixed radial spacings from one another with the tubes extending from the tubesheet on a tube projecting side of the radial plane and the tubesheet being disposed within the vessel such that the radial plane through the tubesheet is axially co-incident with the axially extending placement gap and the first vessel interface structure is disposed on the tube projecting side of the radial plane of the tubesheet, the tubesheet support arrangement comprising:

an intermediary support element having one axial end sealingly connected to the tubesheet and an opposed axial end sealingly connected to the first vessel interface structure which is disposed on the tube projecting side of the radial plane of the tubesheet, the intermediary support element supporting at least the principal portion of the weight of the tubesheet and the tubes on the first vessel interface structure; and wherein the intermediary support element has a decreasing temperature gradient from the sealing contact at which the intermediary support element is in contact with the tubesheet toward the sealing contact at which the intermediary support element is in contact with the first vessel interface structure with the temperature of the intermediary support element at the sealing contact at which the intermediary support element is in contact with the first vessel interface structure being approximately equal to the average temperature of the first vessel interface structure.

6. A tubesheet support arrangement according to claim 5, wherein the temperature of the intermediary support element at the sealing contact at which the intermediary support element is in contact with the first vessel interface structure is nearly equal to the average temperature of the first vessel interface structure.

7. A tubesheet support arrangement for the support of a tubesheet within a vessel, the vessel having a vessel axis and having a first vessel interface structure and a second vessel interface structure axially spaced from one another such that an axially extending placement gap is formed therebetween and the tubesheet having a plurality of apertures arrayed relative to a radial plane through the tubesheet each for receiving therein one of a plurality of tubes such that the tubesheet maintains the tubes at fixed radial spacings from one another with the tubes extending from the tubesheet on a tube projecting side of the radial plane and the tubesheet being disposed within the vessel such that the radial plane through the tubesheet is axially co-incident with the axially extending placement gap and the first vessel interface structure is disposed on the tube projecting side of the radial plane of the tubesheet, the tubesheet support arrangement comprising:

an intermediary support element having one axial end sealingly connected to the tubesheet and an opposed axial end sealingly connected to the first vessel interface structure which is disposed on the tube projecting side of the radial plane of the tubesheet, the intermediary support element supporting at least the principal portion of the weight of the tubesheet and the tubes on the first vessel interface structure;

a sealing connection between the tubesheet and the second vessel interface structure in the form of a fully circumferentially extending topside boundary element having one axial end sealingly connected to the tubesheet and an opposed axial end sealingly connected to the second vessel interface structure;

an outer vessel wall component extending fully circumferentially and having one axial end sealingly connected to the first vessel interface structure;

wherein the inner radius of the outer vessel wall component is larger than the outer radius of the intermediary support element and the outer radius of the topside boundary element such that a circumferentially extending annulus is formed between the outer vessel wall component, on the one hand, and the intermediary support element and the topside boundary element, on the other hand, and insulation material being disposed in the circumferentially extending annulus;

a ring of insulation being disposed radially inwardly of the intermediary support element;

wherein the intermediary support element includes an inner diameter surface and the first vessel interface structure includes a support ring having an inner diameter surface at a lesser radial spacing from the vessel axis than the inner diameter surface of the intermediary support element and the opposed axial end of the intermediary support element is sealingly connected to the support ring; and wherein the temperature of the intermediary support element at the sealing contact at which the intermediary support element is in contact with the first vessel interface structure is nearly equal to the average temperature of the support ring.

8. A tubesheet support arrangement for the support of a tubesheet within a vessel, the vessel having a vessel axis and having a first vessel interface structure and a second vessel interface structure axially spaced from one another such that an axially extending placement gap is formed therebetween and the tubesheet having a plurality of apertures arrayed relative to a radial plane through the tubesheet each for receiving therein one of a plurality of tubes such that the tubesheet maintains the tubes at fixed radial spacings from one another with the tubes extending from the tubesheet on a tube projecting side of the radial plane and the tubesheet being disposed within the vessel such that the radial plane through the tubesheet is axially co-incident with the axially extending placement gap and the first vessel interface structure is disposed on the tube projecting side of the radial plane of the tubesheet, the tubesheet support arrangement comprising:

an intermediary support element having one axial end sealingly connected to the tubesheet and an opposed axial end sealingly connected to the first vessel interface structure which is disposed on the tube projecting side of the radial plane of the tubesheet, the intermediary support element supporting at least the principal portion of the weight of the tubesheet and the tubes on the first vessel interface structure;

a sealing connection between the tubesheet and the second vessel interface structure in the form of a fully circumferentially extending topside boundary element having one axial end sealingly connected to the tubesheet and an opposed axial end sealingly connected to the second vessel interface structure;

an outer vessel wall component extending fully circumferentially and having one axial end sealingly connected to the first vessel interface structure and an opposed axial end sealingly connected to the second vessel interface structure;

wherein the inner radius of the outer vessel wall component is larger than the outer radius of the intermediary support element and the outer radius of the topside boundary element such that a circumferentially extending annulus is formed between the outer vessel wall component, on the one hand, and the intermediary support element and the topside boundary element, on the other hand;

insulation material disposed in the circumferentially extending annulus; and wherein the intermediary support element has a decreasing temperature gradient from the sealing contact at which the intermediary support element is in contact with the tubesheet toward the sealing contact at which the intermediary support element is in contact with the first vessel interface structure with the temperature of the intermediary support element at the sealing contact at which the intermediary support element is in contact with the first vessel interface structure being approximately equal to the average temperature of the first vessel interface structure.

* * * * *